US008225469B2

(12) United States Patent
Bevan

(10) Patent No.: US 8,225,469 B2
(45) **Date of Patent: *Jul. 24, 2012**

(54) FORMATION OF SHEET MATERIAL USING HYDROENTANGLEMENT

(75) Inventor: Christopher Graham Bevan, Stamford (GB)

(73) Assignee: E-Leather Limited, Stamford, Lincolnshire (GB)

( * ) Notice: Subject to any disclaimer, the term of this patent is extended or adjusted under 35 U.S.C. 154(b) by 0 days.

This patent is subject to a terminal disclaimer.

(21) Appl. No.: 10/297,105

(22) PCT Filed: Jun. 4, 2001

(86) PCT No.: PCT/GB01/02451

§ 371 (c)(1),
(2), (4) Date: Nov. 27, 2002

(87) PCT Pub. No.: WO01/94673

PCT Pub. Date: Dec. 13, 2001

(65) Prior Publication Data

US 2003/0134560 A1 Jul. 17, 2003

(30) Foreign Application Priority Data

Jun. 2, 2000 (GB) ..... 0013302.5

(51) Int. Cl.
*D04H 1/492* (2012.01)

(52) U.S. Cl. ..... 28/104; 28/105; 442/408

(58) Field of Classification Search ..... 442/408; 28/105, 104

See application file for complete search history.

(56) References Cited

U.S. PATENT DOCUMENTS

| | | | | |
|---|---|---|---|---|
| 3,493,462 | A * | 2/1970 | Bunting, Jr. et al. | 442/405 |
| 3,560,326 | A | 2/1971 | Bunting et al. | |
| 3,750,237 | A * | 8/1973 | Kalwaites | 28/105 |
| 3,912,581 | A | 10/1975 | Fink et al. | |
| 4,146,663 | A | 3/1979 | Ikeda et al. | 428/96 |
| 4,251,587 | A * | 2/1981 | Mimura et al. | 442/274 |
| 4,488,928 | A | 12/1984 | Ali Khan et al. | |

(Continued)

FOREIGN PATENT DOCUMENTS

| | | |
|---|---|---|
| DE | 19807821 | 9/1999 |

(Continued)

OTHER PUBLICATIONS

Wellington Sears Handbook of Industrial Textiles, Sabit Adanur, 1995, p. 148 on hydroentangling.*

(Continued)

*Primary Examiner* — Elizabeth Cole
(74) *Attorney, Agent, or Firm* — Renner, Otto, Boisselle & Sklar, LLP

(57) ABSTRACT

Artificial leather sheet material is made by hydroentanglement of waste leather fibers. A web of the fibers is advanced on a porous belt high pressure water jet heads in a number of successive hydroentanglement steps. Screens have apertures which allow deep penetration of the water jets into the web while thin screen portions between the apertures act to interrupt the jets allow deep penetration of the water jets into the web while thin screen portions between the apertures act to interrupt the jets and limit formation of furrows. Deflector plates are provided alongside water jet heads to remove rebounding water.

22 Claims, 3 Drawing Sheets

U.S. PATENT DOCUMENTS

| | | | | |
|---|---|---|---|---|
| 4,691,417 | A | 9/1987 | Vuillaume | 28/105 |
| 4,902,564 | A | 2/1990 | Israel et al. | |
| 4,983,245 | A | 1/1991 | Schaefer | |
| 4,984,340 | A | 1/1991 | Nagatsuka et al. | 28/104 |
| 5,023,130 | A * | 6/1991 | Simpson et al. | 442/408 |
| 5,106,457 | A | 4/1992 | Manning | |
| 5,437,904 | A | 8/1995 | Boulanger et al. | 428/91 |
| 5,525,397 | A * | 6/1996 | Shizuno et al. | 428/138 |
| 5,542,703 | A | 8/1996 | Beasley | |
| 6,007,653 | A | 12/1999 | Pirinen et al. | |
| 6,037,282 | A | 3/2000 | Milding et al. | |
| 6,264,879 | B1 * | 7/2001 | Addie et al. | 264/518 |
| 6,442,809 | B1 | 9/2002 | Greenway et al. | |
| 6,699,806 | B1 | 3/2004 | Takeuchi et al. | |
| 2003/0101556 | A1 | 6/2003 | Fleissner | |

FOREIGN PATENT DOCUMENTS

| | | | |
|---|---|---|---|
| FR | 2530665 | A1 * | 12/1984 |
| FR | 2601970 | | 7/1986 |
| JP | 2033366 | | 2/1990 |
| JP | 2033367 | | 2/1990 |
| WO | WO 9729234 | A1 * | 8/1997 |
| WO | 0131131 | | 5/2001 |
| WO | 01/94673 | | 12/2001 |

OTHER PUBLICATIONS

Textile Glossary definition of "wool", 2001.*
Translation of FR 2530665, Dec. 1984.*
Kamath, M.G. et al.; Sunlace (Hydroentanglement); Apr. 2004; pp. 1-23; http://www.engr.utk.edu/mse/Textiles/Spunlace.htm.

* cited by examiner

FORMATION OF SHEET MATERIAL USING HYDROENTANGLEMENT

This is a US National Stage application of PCT Application WO 01/94673 filed Jun. 4, 2001 claiming priority from British Application filed Jun. 2, 2000.

This invention relates to the formation of sheet material from fibres using a process known as hydroentanglement or spunlacing.

The invention is particularly concerned with the production of artificial leather from fibres derived from waste leather.

BACKGROUND

It is well known to reconstitute leather waste into so-called leather board using adhesives. However, the resulting material does not have the suppleness and feel of natural leather due to the stiffening effect of the adhesives used to bond the fibres. Furthermore, the usual shredding and impact processes used to extract the fibres result in very short very fine fibres which give low strength products.

Much longer and more robust textile fibres are known to be formed into non-woven products without adhesives using hydroentanglement (or spunlacing) whereby very fine jets of water are directed into a fibre web at very high pressure to cause mechanical interlocking of the fibres. This can produce strong sheet material with good drape and handle but the lengths of fibres used are generally orders of magnitude longer and thicker than reclaimed leather fibres. It is also known to hydroentangle textile microfibres but these are supplied in the form of bundles of fibres which are temporarily bound together in larger diameters for ease of processing, and subsequently split or separated either by chemical means or in gradual steps by the force of hydroentanglement itself.

Leather fibres are quite unlike those conventionally used in hydroentanglement, and this technique has not been used hitherto with this material.

SUMMARY OF INVENTION

In accordance with the present invention it has been found surprisingly that hydroentanglement (or spunlacing) is in fact useful with leather fibres and can give such intimate interlocking that adhesives need not be used, and can result in a particularly soft handle and adequate strength.

Thus, and in accordance with a first aspect of the present invention there is provided a method of forming a sheet material from fibres comprising the steps of:

advancing a supported body of the fibres and subjecting the advancing body to successive hydroentanglement steps; wherein in each such hydroentanglement step the body is exposed to high pressure jets of liquid over a surface of the body to cause the fibres to be entangled by the jets beneath such surface; and said fibres comprise leather fibres.

Preferably in at least two such hydroentanglement steps a screen is applied to the said surface between the surface and the jets.

Known techniques of hydroentanglement can have limitations on the thickness of material which can be bonded and furrows caused by the material passing under the jets can give an unnatural appearance.

In particular, the very short length of waste leather fibres after extraction gives severe problems of erosion by the jets during entanglement. If jet pressures are reduced to avoid this the exceptionally fine and pliable nature of the fibres tends to cause entanglement to occur unusually rapidly so as to form a finely matted surface layer which resists entanglement of the fibres beneath. The formation of such a layer also resists the drainage of water resulting from the jets, which is usually removed by suction through the fibres from a porous carrier and is essential for effective entanglement. The fine, cloying character of wet leather fibre renders them so impervious that water accumulates on the surface which reduces the effectiveness of the jets and can result in the web being disturbed or even delaminated. Some of these problems can also arise in some circumstances with very fine man made fibres but with leather fibres these difficulties are extreme. This may arise because the mechanical tearing/pounding which may be needed to extract leather fibres breaks down the yarn-like structure of the fibres, and detaches complex shaped microfibres, which unlike manmade microfibres are immediately free for entanglement.

The difficulties are compounded by the thickness of product needed to simulate real leather, which can be significantly greater than the maxim considered processable even for more easily entangled synthetic fibres. The combination of this and the impervious nature of the fibres puts them beyond the experience of practitioners in current spunlacing technology.

A further object of the present invention is to provide a method of hydroentanglement which can be used advantageously with leather fibres and in particular which is suitable for the production of reconstituted leather from waste leather fibres.

According to a further aspect of the invention therefore there is provided a method of forming a sheet material from fibres comprising leather fibres comprising the steps of:

advancing a supported body of the fibres;

and subjecting the advancing body to successive hydroentanglement steps;

wherein:

in each such hydroentanglement step the body is exposed to high pressure jets of liquid over a surface of the body to cause the fibres to be entangled by the jets beneath such surface; and in at least two such hydroentanglement steps a screen is applied to the said surface between the surface and the jets, the screen having multiple small closely spaced apertures with thin solid portions therebetween which interrupt the jets and contain the fibres whilst allowing penetration of the jets through the apertures substantially evenly over the said surface and deeply into the body beneath the surface thereby to effect deep hydroentanglement of the fibres beneath the said surface.

With this method, the use of high pressure jets in multiple hydroentanglement steps with the interposed screen in at least two such steps enables deep, secure interlocking of the fibres, even in the case of very fine, leather fibres, without undue disruption being caused by the high pressure jets. In particular, the screen acts to contain the fibres and restrict impact erosion, and also the interruption of the jets by the solid portions of the screen limits undesirable formation of furrows. Instead of furrows the jets can give localised penetrations which are visually less detectable and around which the fibres entangle at depths determined by the energies of the jets.

Advantageously, the invention permits formation of satisfactory sheet material from relatively thick bodies of fibres say 200-800 gms/sq·meter, prior art techniques being generally more restricted to thinner bodies typically in the range of 20 to 200 gm/sq·meter and with fully entangled thicknesses of under 0.5 mm.

Most preferably in at least one hydroentanglement step, and particularly the said steps with the said screen, penetration sufficient to cause entanglement occurs at least to the centre of the body thickness and preferably through to the opposite side.

Deep entanglement is achieved as a consequence of applying sufficient localised jet energy to break through any fibre matt at the said surface in order to be able to hydroentangle fibres below such surface. Especially where hydroentanglement is to be effected from both sides of the body of fibres penetration is desirable to the middle of the body sufficient to provide a similar degree of entanglement at the middle which might occur at the surface. When hydroentanglement is from one side only penetration completely through the body is desirable. The jet energy is preferably varied (i.e. progressively reduced) in successive steps so that entanglement proceeds from a core depth in multiple penetrations progressing outwardly. Thus, overall entanglement need not reduce towards the interior: even with thick webs with a fully entangled thickness of say 1.5 mm thick and/or with very fine fibres which would otherwise restrict access of the jets to the core depth.

With regard to the different hydroentanglement steps, the operating conditions with regard to jet energies and screen characteristics may be the same or different for the different steps involving successive passes of the web through jets to effect complete entanglement. Preferably the jet energies differ and/or different screen positions or other characteristics are used and/or hydroentanglement is effected with and without screens in different steps whereby fibres between deep penetrations and at different depths can be entangled to give a required degree of entanglement throughout the body of fibres. In accordance with a particularly preferred embodiment, at least one high energy jet step using the screen is followed by at least one lower energy jet step. This is the reverse of normal practice where energy levels are gradually increased with successive steps.

The solid portions of the screen shield parts of the web from receiving the energy requirement to attain a desired degree of entanglement and consequently it is often desirable for the screen to be removed in at least one hydroentanglement step to provide lateral interlocking between the deeply entangled parts not shielded by the screen. This significantly adds to the overall entanglement, but creates furrows or lines, and accordingly it is usually desirable to follow any such step without the screen by at least one step with the screen to mask the furrows and possibly also by at least one step with finer much lower energy jets without the screen to smooth over remaining penetration marks. For best entanglement and to provide a visually fine textured surface in the finished product, the screen apertures should preferably be sufficiently small and close centred to be seen as a texture rather than as pock marks, and may be of a similar order to the very small dimensions that normally separate hydroentangling jets.

The steps may occur at different stations i.e. such that the body of fibres is advanced through different sets of jets and, as appropriate, beneath different screens. Alternatively the steps (or a plurality of the steps) may occur at the same station i.e. such that the body of fibres is advanced repeatedly through the same set of jets in a plurality of passes and, as appropriate, a screen at such station may be introduced or removed or adjusted or changed for different said passes.

Most preferably, the body of fibres is supported on a carrier during advancement. This may be a porous carrier so that liquid from the jets can be removed through the carrier by suction.

The surface structure of the carrier will tend to influence the finish of that surface of the sheet material formed from the body of fibres which is in contact with the carrier. Thus, a smooth carrier of fine porosity is desirable to impart a smooth finish.

In one embodiment the body of fibres is supported on one or more perforated drums during advancement.

The high pressure jets can penetrate very deeply into the body of fibres, preferably to a position at or close to the opposite undersurface of the body of fibres. In so far as it is preferred that the fibres are tightly entangled in a layer immediately beneath the top surface and are also interlocked beneath this layer, it is desirable to minimise the disruptive effects of bounce back (i.e. reflection) of jets from the carrier. Any such bounce back tends to open out the fibres and can occur particularly in later steps when increased entanglement reduces the amount of water that can be drawn away through the porous carrier means. Thus, in at least one said hydroentanglement step the screen (or one said screen) is caused to press against the surface of the body of fibres to resist expansion. The screen may be deflected through an angle so that when the screen is tensioned a component of the tensile force in the screen compresses the body of fibres against the support. Such compression may be at or near points of impact of the jets thereby reducing the depth the jets need to penetrate and resisting internal pressures likely to disturb or delaminate the web. The degree of compression should be such as to provide the required containment without unduly restricting the degree of movement needed by the fibres to entangle effectively with each other. In one embodiment, this is achieved by use of a curved configuration for the screen, particularly a tightly curved configuration within the permissible bending radius of the screen and carrier.

The said screen is configured to avoid furrow formation and preferably also any other obtrusive cavities or other patterns, it being desirable to ensure that the effect of the jets is distributed substantially uniformly and smoothly across the surface of the body of fibres. Accordingly it is preferred that the screen has very small apertures typically of a similar order to the dimensions between adjacent jets and preferably with no aperture dimension exceeding 1 mm and typically in the range 0.4-0.8 mm. It is preferred also that the screen should be predominantly 'open' i.e. having a total aperture area greater than 50% and preferably over 60% of the total screen area. Preferably also the apertures are arranged so that no continuous area of screen material can continuously shield the path of any jet and the pitch of the aperture centres along the line of the jets is the same as the centre-line pitch of the jets. This avoids periodic lines forming on the surface of the walls due to rhythmic coincidence effects. Moreover, the screen preferably has very thin solid portions between the apertures, preferably less than 0.15 mm thickness. These thin portions and highly specific aperture dimensions are not generally available in standard screens but may be achieved by use of perforated thin-gauge monolithic material, particularly a thin, flat metal sheet which is provided with perforations by chemical etching.

The volume of water from the high pressure jets combined with the poor relative imperviousness of wet leather fibres give rise to an excess of liquid at the surface of the body of fibres and/or at the surface of the screen where used. It is desirable to remove this liquid to prevent it flooding where the jets impact the surface and cause loss of energy imparted to the web and disruption or loosening of the entangled fibres. Thus, preferably deflector plates are arranged on either side of the line of jets to capture liquid from the jets after rebounding from the body of fibres and/or screen so that this water cannot return to flood the surface. Some flooding of the surface can arise in normal practice as the webs are consolidated after many passes under the jets, but with leather fibres flooding commences near the beginning of the process steps, and the web flattens to the extent that the water rebounds in a manner not seen with conventional webs. The deflector plates are positioned between the web and the body of the jet head delivering the water so that water rebounding from the web or screen is collected by the plates after it has rebounded a second time on the body of the jet head (or a plane closely attached thereto). Collected liquid may be removed from the plates by suction or otherwise, preferably at a rate to keep pace with collection.

Where it is desired to produce a finely entangled layer at the said surface, for example simulating the 'grain' of natural leather, this may be achieved by turning over the body of fibres after hydroentanglement with the above described method of the invention, so that the said surface contacts an appropriate support face, the fibres adjacent such face then being hydroentangled using jets from the opposite face of sufficient energy to penetrate through the body of fibres sufficiently to entangle the microfibres lying against the support face, thereby forming a smooth surface substantially free of cavity marks from the screen. Prior to turning over, a final hydroentanglement step may be performed using lower jet energies which produce substantially smaller and shallower surface cavities or furrows and the support face may comprise a porous but fine textured carrier, the energy of the jets used after turning over being sufficient to entangle the fibres at the 'grain' surface whilst such fibres lie closely against the fine textured carrier.

The fibres used in the present invention may consist wholly of, leather fibres or include a proportion of any suitable natural fibres or synthetic reinforcing fibres, this proportion generally depending on the degree of extra strength required. Generally for most applications some reinforcement is needed as the leather fibres after disintegration impart insufficient strength however well entangled.

The incorporation of synthetic fibres tends to detract from the feel and handle of natural leather, and particularly for suede finishes, it is desirable to keep synthetic fibres away from the outer layers unless such fibres are sufficiently fine and in a low enough proportion not materially to affect the leather-like feel. Synthetic fibres within this category may be the aforesaid microfibres.

In order to provide sufficient reinforcement in the least obtrusive way and in particular to provide pure leather external surfaces, the body of leather fibres may be supported on and attached to a reinforcing fabric or scrim which may be of any suitable structure e.g. woven, knitted, felted, spunbonded or the like. Bonding to the fabric may be achieved by hydroentanglement without requiring adhesives particularly by a hydroentanglement step of the process of the invention which causes fibres of the body of fibres to penetrate in this case sufficiently deeply to drive fibres into the interstices of the fabric thereby locking them mechanically into the fabric. There may be one or more fibre layers e.g. on one or both sides of the fabric. The fabric may be selected with a tightness of weave and surface texture so that its pattern is not reflected on the surface of the final product and the yarn in the fabric does not fray from cut edges of the final product. Such fabrics may have a yarn count of 20 to 60 yarns per centimeter, which is much finer than normal "scrim" reinforcing fabric.

Mechanically bonding leather fibres to a reinforcing fabric in this way eliminate the stiffening resulting from normal textile adhesive bonding and any damage or dislocation to the fabric that can arise with conventional mechanical bonding by needle punching.

In order to provide good wearing properties to the finished product and anchor the fibres most effectively to the reinforcing fabric and to each other, the leather fibres need to be as long as possible. Conventional hammer milling of waste leather produces fibres that are too short and damaged for applications in this context. Furthermore, such conventional fibres are generally produced from leather "shavings" derived from trimming the surface of hides, and this action itself considerably shortens the fibres. To achieve best product quality, leather fibres of superior length are derived from tannery "sheet" waste, which comprises off-cuts from slitting wet hides in the plane of the hides after tanning but before significant further tannery processing. Such waste can be converted to fibres by conventional hammer milling but for optimum fibre length the preferred method is by conventional textile fibre reclaiming equipment. Such equipment consists essentially of a succession of rotating spiked cylinders, which progressively rip or tear the material to release the fibres, with each stage producing more fibres and increasingly smaller residual pieces. Fibres produced by such means are particularly suited to being mechanically bonded to an internal fabric reinforcement, as the fibres have sufficient length and integrity to provide good wear properties and all the feel and handle of natural leather after hydroentanglement.

The liquid used in the jets is preferably water.

The invention also provides apparatus for use in performing the above described methods of the invention comprising a plurality of treatment stations, a porous conveyor for supporting a body of fibres comprising leather fibres whilst advancing such body successively through the stations, liquid outlets at each such station for subjecting the supported body of fibres comprising leather fibres to high pressure jets of such liquid, a screen arranged to be interposed between the outlets and the supported body at at least two said stations, and at least one pair of liquid removal deflector plates arranged adjacent to said outlets to capture liquid rebounding from the supported body or any screen at least two said stations.

The various above described aspects of the invention and features thereof may be utilised or applied alone or in any combination thereof.

The invention will now be described further by way of example only and with reference to the accompanying drawings in which:—

DETAILED DESCRIPTION

Figure 1:
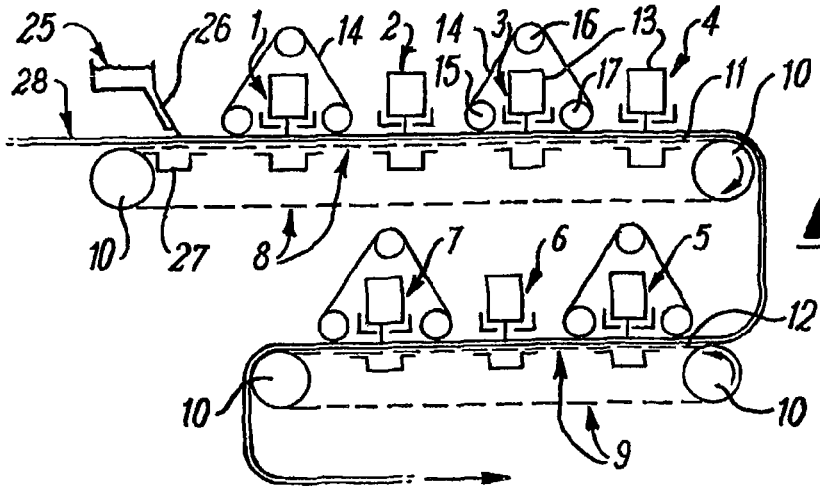
FIG. 1 is a diagrammatic representation of one form of apparatus having multiple treatment stations in accordance with one embodiment of the invention.

Referring to FIG. 1, this shows apparatus for use, by way of example, in converting leather waste microfibres into a coherent sheet of reconstituted artificial leather.

The apparatus, as shown, has seven treatment stations 1-7. Two endless conveyor belts 8, 9 in the form of porous carriers (such as open fabrics or wire meshes or other similar material are driven continuously around rollers 10 so that upper runs 11, 12 of the belts 8, 9 advance successively through the stations 1-7.

Each station 1-7 comprises a hydroentanglement head 13 consisting of one or more rows of fine jet outlets which extend from above across the respective belt 8, 9 and are connected to a source of pressurised water whereby jets of water can be directed from the outlets towards the belt 8, 9 at each station 1-7. The pressure and the physical characteristics of the outlets, and hence the jet energies can be individually selected and controlled for each station.

Two of the stations 1, 3 over the first belt 8, namely the first and third, and two of the stations 5, 7 over the second belt 9, also the first and third, incorporate screens 14, the other stations 2, 4, 6, in between these stations 1, 3, 5, 7, being without screens.

Before the first station 1 over the first belt 8 there is arranged a water reservoir tank 25 with an outlet which discharges to an inclined plane 26 extending across the upper run 11 of the belt 8 in order to thoroughly pre-wet the fibres.

Beneath the upper run 11 of the belt 8, in the vicinity of the inclined plane 26 there is disposed a suction box 27 in order to thoroughly de-aerate the web and bring the fibres closer together ready for entanglement.

Figure 2:
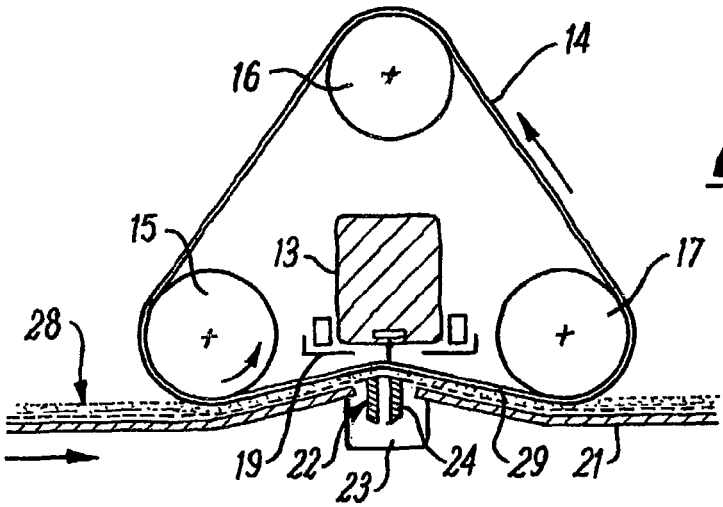
FIG. 2 is a diagrammatic cross-section through one station of the apparatus of FIG. 1.

As shown in FIG. 2, each screen 14, as described in more detail hereinafter, comprises an endless finely perforated band which is driven continuously around a triangular arrangement of three cylinders 15-17 so that a lower run 29 of the screen 14 extends in close contact with web 28 where the jets impact, the web being carried on the upper run 11, 12 of the respective belt 8, 9 and advancing in the same direction as such run 11, 12.

Figure 3:
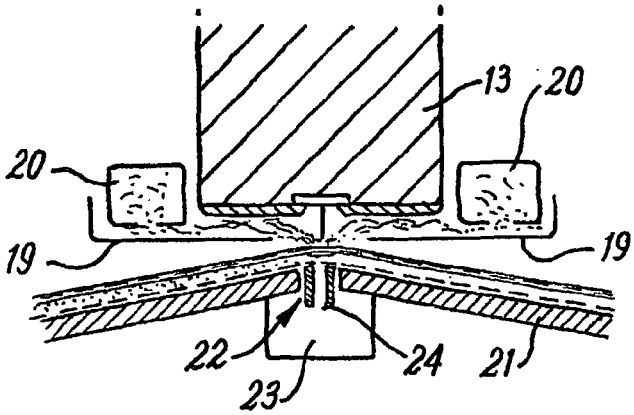
FIG. 3 is an enlarged diagrammatic cross-sectional view of a detail of the arrangement of FIG. 2.

As seen more clearly in FIG. 3, water collection deflector plates 19 are located adjacent to each jet head 13 and suction tubes 20 are disposed over the trays 19 for removing water in the trays.

At each station 1-7 beneath the upper run 11, 12 of the porous carrier belt 8, 9 there is a smooth impermeable support table 21 over and in contact with which the belt 8, 9 runs. Centrally of this, immediately beneath the jet head 13 there is a slot-shaped gap 22, across the belt 8, 9, beneath which there is a suction box 23.

The surface of the table 21 is inclined or curved centrally to an upwardly directed apex centred on the slot 22 and within which there may be support edges 24.

In use, a web 28 of the leather fibres is fed on to the upper run 11 of the first belt 8 whereby the web 28 advances successively beneath the inclined plane 26 (or equivalent pre-wetting and de-aeration means) and then successively through the different treatment stations 1-7.

As appropriate the web 28 may be saturated with water from the inclined plane 26 and excess water and most of the air within the web 28 are removed by the suction box 27.

At each of the screen stations 1, 3, 5, 7, the web 28 is compressed between the screen 14 and the porous carrier belt 8, 9. The compression is maintained by the angular path of the screen 14 determined by the aforementioned angular configuration of the support table 21. The lower run 29 of the screen 13 between the two lower cylinders 15, 17 is deflected upwardly whereby tensioning of the screen 13 around the cylinders 15, 16, 17 acts to pull this lower run 29 downwardly onto the web 28.

At each station 1-7, water from the jet head 13 is directed downwardly into the web 28. Excess water rebounding from the top surface of the web 28 or from the respective screen 14, where present, is collected by the deflector plates 19 and removed through the suction tubes 20. Other water is removed through the suction box 23. Effective suction of water through web and carrier belt is important to ensure that the fibres are maintained in close proximity to each other during hydroentanglement to ensure effective interlocking of fibres. This normally requires a vacuum of at least 150 mbar and for thick webs up to 600 mbar can be preferable. This is considerably higher vacuum than used in normal practice and is a consequence of the unusually impervious nature of leather fibres.

Figure 4:
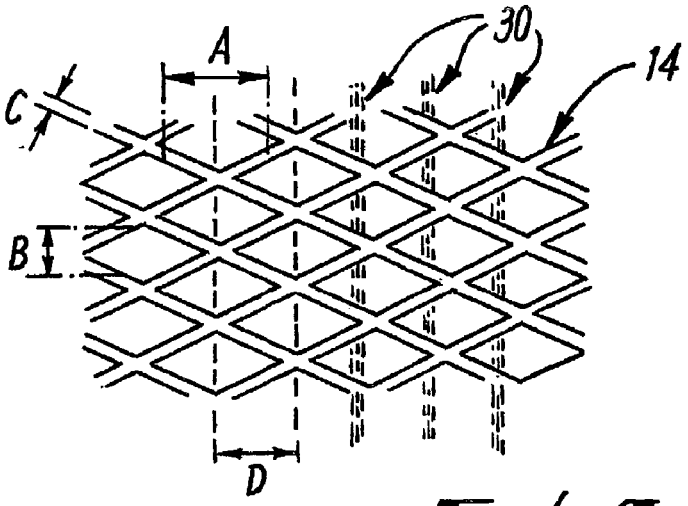
FIG. 4 is an enlarged top view of a detail of the arrangement of FIG. 2 showing the structure of a screen used at the station.

FIG. 4 shows apertures of a typical perforated screen (14) in relation to the lines or furrows (30) on the web 28 that would otherwise result from the web passing under the row of jets in the absence of the screen. Interposing the screen as shown in FIG. 3 transforms the furrows that would otherwise result, into localised cavities centred at or near the centre of each screen aperture. Typical screen aperture dimension (A) in the cross direction of the screen belt is around 0.8 mm, and dimension (B) in the machine direction is around 0.5 mm; both dimensions are of the same order of magnitude as the centreline spacing of typical jets at 0.4 mm to 1.0 mm and in this case designed for jets spaced at 0.6 mm with the centres of adjacent lines of apertures (D) also spaced at 0.6 mm in order to avoid surface markings from rhythmic coincidence effects. Mesh thickness (C) is 0.15 mm, and the width of screen material between apertures is also approximately 0.15 mm, which is small enough to provide an open area of about 55%.

Figure 5:
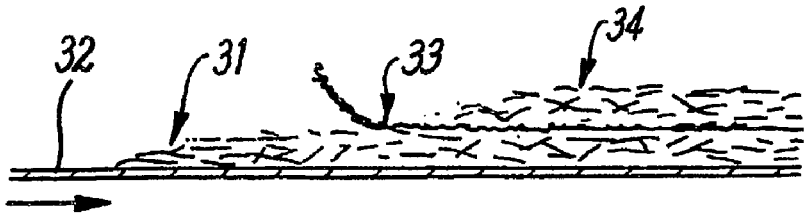
FIGS. 5 & 6 are diagrammatic cross-sectional views of different layered webs constructed using the apparatus of FIG. 1.

FIG. 5 shows a typical web where leather fibres (31) are airlaid by conventional means onto a porous carrier (32), followed by a knitted or woven reinforcing fabric (33) typically of nylon or polyester, and a further layer of leather fibres (34). The fibre layers are produced by the aforesaid textile reclaiming means and at this stage have little intrinsic strength and pass directly to the hydroentangling stations on the porous carrier belts. The width of web is sufficient to produce a trimmed product width of 1.5 m.

Figure 6:
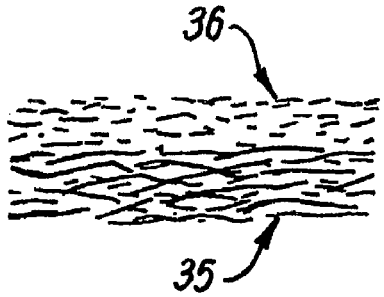

FIG. 6 shows an alternative web comprising reinforcing layer (35) and a finish layer (36). The reinforcing layer may be a web of equal parts by weight of leather fibres and 3.3 dtex, 50 mm polypropylene fibres formed by conventional carding procedures, and a top finish layer (36) may be airlaid leather fibres without polymer fibres or with a much smaller proportion of polymer fibres to maintain as much as possible a leather-like feel to the finished surface.

In order to entangle the web shown in FIG. 5 to produce a leather-like product with a simulated grain face, the web is passed beneath the inclined plane and then through the 7 hydroentangling stations at a speed of around 6 m/minute, as shown diagrammatically in FIG. 1. The water saturated and de-aerated grain face and back faces are then hydroentangled in a sequence as follows:

| Pass number | Screen used | Jet diameter (microns) | Jet centres (mm) | Jet pressure (bar) |
|---|---|---|---|---|
| Grain face: | | | | |
| 1 | yes | 120 | 0.60 | 200 |
| 2 | no | 130 | 0.80 | 170 |
| 3 | yes | 120 | 0.60 | 140 |
| 4 | no | 60 | 0.47 | 70 |

-continued

| Pass number | Screen used | Jet diameter (microns) | Jet centres (mm) | Jet pressure (bar) |
|---|---|---|---|---|
| Back face: | | | | |
| 5 | yes | 120 | 0.60 | 200 |
| 6 | no | 130 | 0.80 | 140 |
| 7 | yes | 120 | 0.60 | 140 |

For the grain face, maximum jet pressure is applied in the first pass (ie the opposite of normal practice) in order to penetrate deeply. This drives the leather fibres into the interstices of the fabric before a barrier is formed, and generates a mass of individual stabilised points. These points are linked in the plane of the web by Pass 2, which without a screen, entangles areas shielded by the preceding screen. This is followed by Pass 3 using a screen in order to provide further locally entangled points but at a reduced jet pressure to entangle less deeply. The moderate cavities from Pass 3 are smoothed over by Pass 4 using close spaced, small diameter jets without the screen, at jet pressures low enough not to leave noticeable lines after subsequent hydroentangling from the back.

For the back face, the web is transferred to the second porous carrier (9) so the grain face lies against a smooth textured surface of the carrier. Passes 5, 6 and 7 follow a similar pattern of alternating passes with and without screens as for the grain face, but with the fall off in jet pressures and diameters being considerably less. This provides and maintains sufficient entangling energy to reach through the web, so that fibres at the grain face entangle with each other while they are effectively moulded against the carrier. This provides a grain finish without visible cavity or jet marks on removal from the carrier. Cavity marks on the back are masked later by subsequent buffing procedures to give a coarse suede effect similar to the back face of real leather.

Screen apertures in the example are arranged in the diagonal pattern shown in FIG. 4, so the screen cannot periodically obscure jet paths along their length. The screen is made from thin stainless steel sheet using conventional acid etching techniques and photographic templates to reproduce the apertures. The etched sheets are joined into belts as shown in FIGS. 1 and 2 using micro-braising techniques similar to those used for making fine seamless woven wire belts.

In order to form the layered web in FIG. 5, leather fibres are airlaid using a well known commercially available process designed principally for laying wood pulp fibres. Here fibres are circulated through the axes of a pair of counter rotating perforated drums positioned over a porous belt, and are drawn through the perforations onto the belt by air extraction from beneath the belt assisted by rapidly rotating spiked shafts within the drums. One pair of drums deposit fibre layer (31), providing an even layer of around 200 gsm, followed by knitted nylon or woven fabric (33) at around 90 gsm, and then fibre layer (34) at around 200 gsm deposited by a second pair of drums. For leather fibres a 200 gsm layer can be deposited at a carrier belt speed of around 3 m/minute and for greater speeds the number of drums must be increased appropriately. The total weight of around 490 gsm gives a final product thickness, depending on finishing procedures, of around 1.0 to 1.2 mm.

The fibre length resulting from disintegrating the waste leather in textile reclaiming equipment ranges from less than 1 mm with occasional fibres up to 20 mm and an average length greater than for typical wood pulp fibres or leather fibre produced by hammer milling. The fibre structure of natural leather before disintegration consists of closely interwoven slightly twisted bundles of filaments, which in turn consist of even finer fibrils, many of which become detached during the severe mechanical action needed to break up the weave. This results in a range of fibre diameters from about 100 microns for the bundles to very fine fibres below 1 micron for individual fibrils. These very fine fibres greatly increase the surface area of the mix and profoundly affect permeability and other process characteristics compared to normal textile fibres.

After hydroentanglement, the wet, consolidated web can be treated by conventional procedures to produce a leather-like material suitable, for example, for clothing and upholstery applications. Typical procedures include dyeing, treating with softening oils, drying and surface finishing either by polymeric coating as in conventional leather or by abrading to give a suede effect. The web before finishing is remarkably like natural chrome tanned "wet blue" from which the fibres are derived, the main differences being that the reconstituted material is less dense and is in a regular form. Because of the closeness to real leather, established leather finishing procedures can be used, but because of the continuous regular shape, the application of such procedures can be by continuous textile methods rather than the batch methods used for leather.

Figure 7:
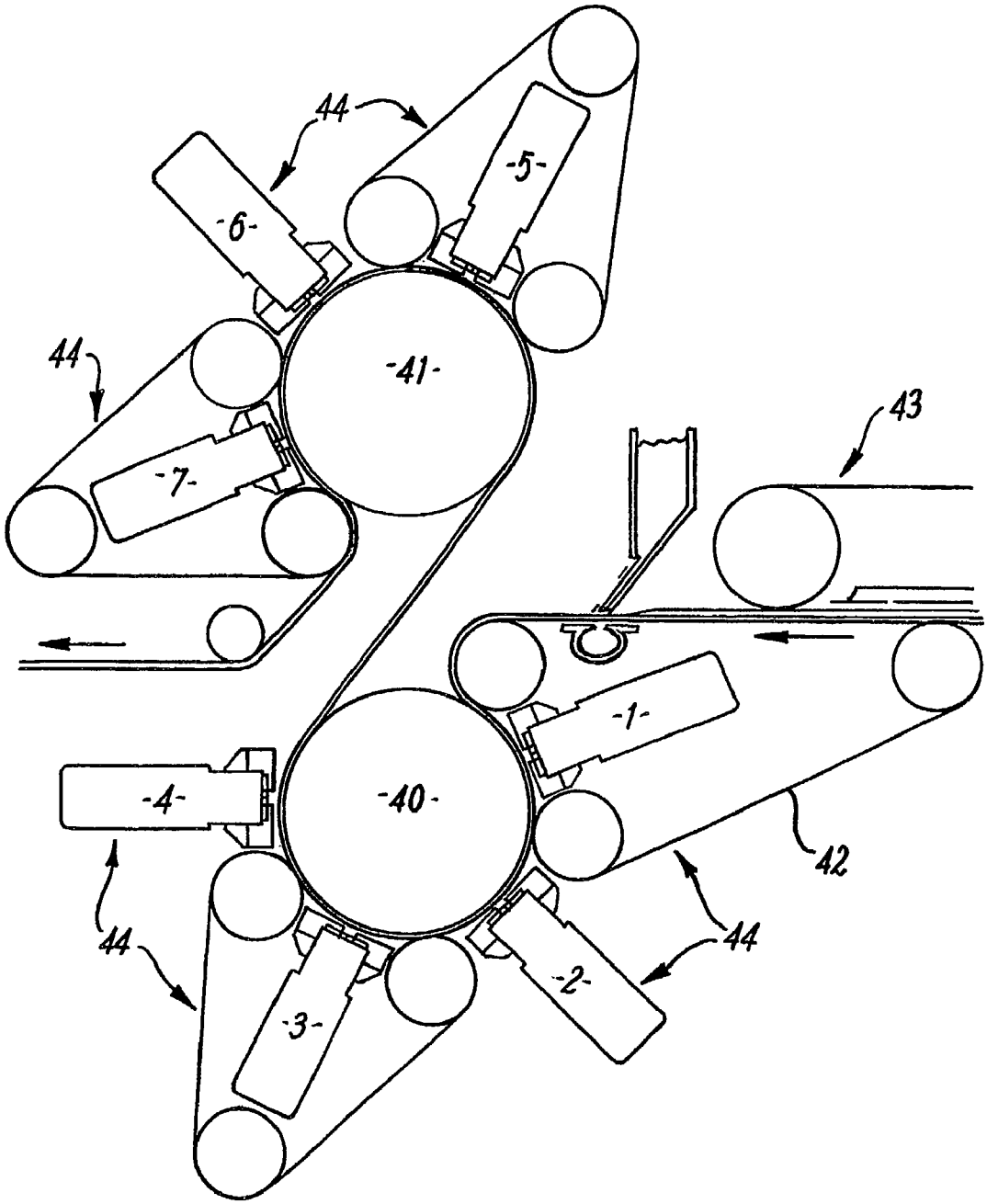
FIG. 7 is a diagrammatic representation of an alternative form of apparatus using perforated drums.

FIG. 7 shows an alternative form of equipment using two perforated drums 40, 41 as porous carriers. The fibre web is applied to a feed belt 42 from a vacuum transfer device 43.

The web then passes round the first drum 40 which has four stations 44 (as described in connection with the embodiment of FIG. 1), and then around the second drum 41 which has three further stations 44. The first station 44 of drum 40 is integrated with the belt 42. As shown, some of the stations do not have screens.

The web passes in opposite directions around the drum 40, 41 so that the top (finish) face of the web is exposed to injection on the first drum, and the back face on the second drum 41.

The invention is not intended to be restricted to the details of the above embodiments which are described by way of example only. Some variations are detailed as follows:

The hydroentangling method described is particularly suited to leather fibres but applies also to mixtures containing other fibres, usually for the purpose of providing adequate strength or wear properties to the final product. Usually the leather comprises the greatest proportion by weight of total fibres, but even at high concentrations of synthetic fibre, the peculiar hydroentangling characteristics of leather fibres dominate processing considerations and require the special techniques described in this invention.

Fabrics suitable for use in the above described method do not usually require specific weave openings to promote mechanical bond to leather fibres, as a proportion of fine leather fibres is normally driven by penetrating jets into the openings or even into the structure of the yarn making up the fabric. For thin products a close, even weave is preferred in order to minimise the weave pattern from showing on the surface of the product when finishing procedures involving high pressure are used. For thick webs a more open weave is preferred, as this causes less obstruction to the vacuum draining during hydroentanglement.

Depending on final product requirements, fabrics can be woven, knitted, or non-woven (eg spun bonded), and may use common man made yarns like nylon or polyester. These usually provide adequate product strength with 40 to 150 gms fabric weight depending on the product application, and such fabrics are normally thin enough for leather fibres to penetrate right through the fabric.

Webs may contain more or fewer layers than those shown in FIGS. 5 and 6, and may consist of only one layer. For applications where a reinforcing fabric is not wanted, sufficient strength can be provided (for example) by blending longer fibres with leather fibres to form a web such as shown in FIG. 6. In this example, the blended layer (35) may need up to 50% of conventional textile fibre to provide the required product strength. This type of mixture is difficult to lay other than by carding, while if the finish layer (36) is pure leather fibre such fibres are generally too short to be laid by carding and can usually only be laid by methods used in the paper making industry such as the aforesaid airlaying or wet laying. However, leather fibres produced by the aforesaid textile means are long enough to be laid by carding if blended with at least 5% of textile fibre to carry the leather fibres through the carding process.

Webs can be formed by any means, and long leather fibres have the unique advantage over hammer milled fibres that blends with textile fibres can be carded without a substantial proportion being ejected during carding. Unlike carding, airlaying plant is specifically designed to handle relatively short fibres, and the leather fibres produced by the aforesaid textile means can be near the limit of fibre length for such equipment and fibre length and operating procedures need to be adjusted appropriately.

Thicker webs generally need higher pressures to provide the deep initial penetration needed to entangle the interior. Available pressures in hydroentangling are commonly around 200 bar which is sufficient to entangle 490 gsm of web in the example. Higher pressures are available and have the advantage of allowing higher carrier belt speeds but need more expensive pumping equipment. Web weights of the order of 800 gsm can be processed, which is sufficient for most leather applications, and is beyond what is normally considered feasible for hydroentangled artificial leather even for more easily entangled synthetic fibres using conventional means. Alternatively, where very thin products are wanted and a non-leather appearance is acceptable on the back face, the fibre layer on the back may be omitted altogether, bringing web weight down to 290 gms or less. Fibres in the single remaining layer will key fully into the fabric from one side, despite having no fibres on the opposite side to which they can link.

As with normal hydroentangling, jet diameter, jet spacing and pressure are all factors which determine the hydroentangling energy supplied to the web. This energy also broadly determines penetration, but for the same energy delivered to the web, large diameter jets at large spacing can penetrate and drain better than smaller jets at closer centres. Larger jets also cause more distinct jet lines, but when a fine screen is interposed, the resulting markings tend to take on the character of the screen almost regardless of the original jet lines. This feature is exploited in the sequence of passes described above. Generally for the screen apertures, jet pressures and belt speed described in the foregoing, sufficient energy is provided by normal jets with typical diameters ranging from 60 to 140 microns and jet spacing from 0.4 mm to 1.0 mm.

The 6 m/minute belt speed is considerably slower than for normal hydroentangling production, which can be 10 to 50 times faster. Higher speeds are feasible for thinner webs and/or higher jet pressures, and speeds of above 10 m/minute are known to be effective for some web configurations. However, generally the nature of leather fibres limits production speed compared to normal spunlace products. As with normal spunlacing, finding the optimum condition of jet diameter, spacing and pressure, and carrier belt speed can only be determined by practical trials using representative equipment.

Apertures can be different shapes than shown in FIG. 4, and may be larger where surface finish requirements permit this or where coarse screens are followed by fine ones. Even so, these "coarse" apertures are preferably still quite fine compared to normal mesh sizes, and to produce the aforesaid grain finishes, fine screens are essential. Where screen marking is acceptable woven meshes can be used with the present invention (but using small apertures). Available mesh screens have unfavourable open areas for the preferred aperture sizes, and are generally only suitable for coarsely finished applications where screen marks are of less concern.

The water collection plates in FIG. 3 are designed to suit the tight spaces between the underside of a normal jet head and the web. However, water collection can be by any means provided water rebounding off the web is removed before it can return to the surface. Deflector plates similar to those in FIG. 3 can also be effective when webs are supported on perforated drum conveyors as commonly used in conventional hydroentangling, and tray assemblies may be disposed at angles corresponding (for example) to the position of the heads around the drums. Depending on such angles, water can be removed from the trays under gravity rather than suction as illustrated, and entire assemblies can be upside down with jets directed upwards and water collected downwards after rebounding off a web held to the carrier by a screen and/or suction. Such a layout is shown in FIG. 7.

The screen needs to be in close contact with the web where the jets impinge, and the screen may be simply laid flat onto the web. More positive compression is preferable, however, as this prevents disruption of the web due to water rebounding within the web and reduces the depth that needs to be penetrated. Webs usually bed down fairly easily, and for the angular configuration shown in FIG. 2, normal belt tension needed to hold a chemically etched belt on track can provide sufficient force on the web. With drum conveyors, the curvature of the drums themselves can provide sufficient angular change to generate adequate compression in the web. Web compression also helps to limit drafting of the web during entanglement, but this is not usually an issue with the preferred fabric reinforcement as the fabric itself controls drafting.

The number of passes needed varies depending on product requirements such as web thickness and finishing treatment, and is also influenced by the energy delivered per pass. At least 2 passes are required, and usually no more than 8 are used. In the case of thin webs of say around 200 gsm total weight the number of passes can be reduced to 4 particularly if the leather fibre layer is on one side of the fabric only. In the latter case 2 passes can provide the basic consolidation, leaving 2 relatively low energy passes for finishing.

Whilst at least two of the passes requires the screen described above, more such passes are usually needed to make a saleable leather-like product. Screens can be at every station rather than alternately as shown in FIG. 1, but, the constant application of small localised penetrations can result in a more tufted fibre structure, which may not suit some applications. Alternatively, a higher proportion of passes than in the example may be without screens in some applications. Also, instead of completing all passes on one side before starting the other side as in FIG. 1, it can (for example) be beneficial to start entangling the back face first, complete all the passes on the front, and turn again to complete the back.

Although the preferred raw material is waste bovine "wet blue", non-bovine sources and other off-cuts such as from shoe production can be used. However, shoe waste is inconsistent due to variable finish treatments.

After hydroentangling the reconstituted material looks very like the wet blue from which the fibres were derived, and is thereafter treated in similar ways to normal leather practice. Such treatments include impregnations to soften or stiffen handle and in some cases may lightly bond the fibres. However such bonding contributes little to overall tensile strength and product integrity depends primarily on entanglement.

Pre-wetting using the inclined water delivery means (26) and de-aeration by the vacuum box (27) are useful to ensure that the fibres are wet and in reasonably close proximity to each other to obtain maximum entangling benefit from the first pass. More intimate pre-wetting and de-aeration can be achieved by passing the water onto the web while it is held by a woven wire belt or other screen in accordance with known methods for synthetic fibres.

However, such methods are not normally needed for leather fibres which do not form such bulky webs as in normal practice which can require positive holding down during prewetting. Such conventional prewetting methods can also lightly entangle the fibres to stabilise the web against drafting during the normal hydroentangling process but this is unnecessary with the preferred fabric reinforcement and does not produce the deep penetration which is an important basis of this invention.

The present invention also provides sheet material made using the method or apparatus described above. This sheet material may closely simulate natural leather and in particular may have a leather-like 'grain' on one or both surfaces. The fibres may be at least predominantly leather fibres.

Thus, and in accordance with a further aspect of the invention there is provided reconstituted leather sheet material comprising fibres interlocked with each other by entanglement, said fibres comprising leather fibres.

Sheet material in accordance with the invention may further include a textile reinforcing fabric, the fibres also being entangled with this substantially without any dislocation or breakage (rupturing) of the fabric such as occurs with needle punching. Except for the aforesaid possible impregnation finishing treatments, no adhesive is necessary to structurally bond the fibres. Thus, the sheet material may be substantially without any adhesive bonding of the fibres, the mechanical interlocking of the fibres being the sole or predominant means of attaining and maintaining the integrity of the structure.

The sheet material may comprise at least predominantly or exclusively leather fibres or the fibres may also include synthetic fibres.

The invention claimed is:

1. A method of forming a reconstituted leather sheet material for use in place of natural sheet leather, the method comprising:

providing a body formed by a web or webs of predominantly waste leather fibres, the fibres comprising leather fibres produced by mechanical disintegration of waste leather using textile reclaiming methods;

using hydroentangling jets to hydroentangle the leather fibres in the body while the body is supported on a porous conveyor so as to form the reconstituted leather sheet material wherein the hydroentanglement of the leather fibers is the primary mechanism for holding the leather fibres together through the entire thickness of the body, and wherein the hydroentangling includes an early pass at relatively high jet pressure to entangle interior leather fibres of the body with each other, followed by additional hydroentangling passes at relatively lower pressures to entangle the leather fibres in outer regions of the body with each other.

2. The method of claim 1, wherein the hydroentangling includes applying a screen to a first surface of the body opposite a second surface of the body supported by the porous conveyor during at least the early pass at relatively high pressure.

3. The method of claim 2, wherein the screen has multiple spaced apertures separated by solid portions therebetween, the spacing of the apertures is substantially the same as the spacing of the hydroentangling jets.

4. The method of claim 3, wherein the aperture area of the screen is greater than 50% of the total screen area and the screen has adjacent rows of apertures in the direction of advancement through the hydroentanglement system with the spacing of center lines of adjacent rows being of an order of magnitude similar to the separation of adjacent jets.

5. The method of claim 2, wherein jet energy and/or screen position are varied for different hydroentanglement passes.

6. The method of claim 2, wherein suction is applied to the body via the porous conveyor in order to assist in removing liquid through the body delivered by the hydroentanglement jets.

7. The method of claim 6, including using a collection device positioned adjacent the hydroentangling jets and the surface of the body to collect rebound liquid from the jets that rebounds off the surface of the body due to matting of the base fibres that prevents full drainage by suction through the body of liquid delivered by the hydroentangling jets, such collection occurring before the liquid falls back onto the surface of the body thereby to minimize the amount of rebound liquid that falls back on the surface of the body that otherwise would interfere with the penetration of the hydroentangling jets into the body.

8. The method of claim 1, wherein the body has an area density of 200-800 gms/sq, meter.

9. The method of claim 1, wherein the passes occur at different stations and the porous conveyor advances the body through the stations.

10. The method of claim 9, wherein the porous conveyor includes one or more porous drums.

11. The method of claim 1, wherein the hydroentangling includes applying a screen to a first surface of the body opposite a second surface of the body supported by the porous conveyor during at least the early pass at high pressure, and the screen is deflected so that it compresses the body when tensioned.

12. The method of claim 1, wherein the hydroentangling includes applying a screen to a first surface of the body opposite a second surface of the body supported by the porous conveyor during at least the early pass at high pressure, and the screen has apertures aligned along diagonal paths relative to the direction of advancement.

13. The method of claim 1, wherein the hydroentangling includes applying a screen to a first surface of the body opposite a second surface of the body supported by the porous conveyor during at least the early pass at high pressure, and the screen is a thin, flat metal sheet provided with perforations by chemical etching.

14. The method of claim 1, including using a collection device positioned adjacent the hydroentangling jets and the surface of the body to collect rebound liquid from the jets that rebounds off the surface of the body due to matting of the base fibres that prevents full drainage through the body of liquid delivered by the hydroentangling jets, such collection occurring before the liquid falls back onto the surface of the body thereby to minimize the amount of rebound liquid that falls back on the surface of the body that otherwise would interfere with the penetration of the hydroentangling jets into the body.

15. The method of claim 1, wherein the hydroentangling jets are directed against a first surface of the body during one pass and against an opposite surface of the body during a later pass.

16. The method of claim 1, wherein the body is mechanically bonded by hydroentanglement to a textile reinforcing fabric.

17. The method of claim 1, wherein the waste leather fibres are produced by ripping or tearing waste leather to release the waste leather fibres.

18. The method of claim 1, wherein the body also includes synthetic fibres.

19. The method of claim 1, wherein the leather fibres are derived from waste leather by subjecting said waste leather to ripping or tearing to release the fibres.

20. The method of claim 1, wherein the relatively high jet pressure is at least 140 bar and the diameters of the jets of liquid are from about 60 microns to about 140 microns.

21. The method of claim 1, wherein the jets of liquid are applied to a first surface of the body while a vacuum of at least 150 bar is applied to the opposite surface of the body.

22. The method of claim 1, wherein the jets are spaced about 0.4 to 1.0 mm apart.

* * * * *